US007143790B2

(12) United States Patent
Liao

(10) Patent No.: US 7,143,790 B2
(45) **Date of Patent: *Dec. 5, 2006**

(54) WARP-STRETCH WOVEN FABRICS COMPRISING POLYESTER BICOMPONENT FILAMENTS

(75) Inventor: Tianyi Liao, Wilmington, DE (US)

(73) Assignee: Invista North America S.a.r.l., Wilmington, DE (US)

( * ) Notice: Subject to any disclaimer, the term of this patent is extended or adjusted under 35 U.S.C. 154(b) by 159 days.

This patent is subject to a terminal disclaimer.

(21) Appl. No.: 10/718,483

(22) Filed: Nov. 20, 2003

(65) Prior Publication Data

US 2005/0109418 A1 May 26, 2005

(51) Int. Cl.
*D03D 15/08* (2006.01)
*D03D 15/00* (2006.01)

(52) U.S. Cl. ..... 139/421; 139/422; 139/420 R; 139/426 R; 139/420 A

(58) Field of Classification Search ..... 139/420 R, 139/421, 422, 426 R, 420 A
See application file for complete search history.

(56) References Cited

U.S. PATENT DOCUMENTS

| | | | | |
|---|---|---|---|---|
| 3,350,871 | A * | 11/1967 | Pierce et al. | 57/245 |
| 3,373,774 | A * | 3/1968 | Cruz | 139/420 R |
| 3,671,379 | A | 6/1972 | Evans | |
| 6,548,429 | B1 * | 4/2003 | Lintecum et al. | 442/199 |
| 6,659,139 | B1 * | 12/2003 | Laycock et al. | 139/422 |
| 6,705,353 | B1 * | 3/2004 | Hotta et al. | 139/421 |
| 6,782,923 | B1 * | 8/2004 | Covelli | 139/440 |
| 6,803,000 | B1 * | 10/2004 | Ochi et al. | 264/103 |
| 6,841,245 | B1 * | 1/2005 | Chang et al. | 428/373 |
| 6,877,197 | B1 * | 4/2005 | Van Trump et al. | 28/247 |
| 6,974,628 | B1 * | 12/2005 | Van Trump et al. | 428/370 |
| 2001/0055683 | A1 | 12/2001 | Ochi | |
| 2003/0092339 | A1 | 5/2003 | Covelli | |

FOREIGN PATENT DOCUMENTS

| | | |
|---|---|---|
| JP | 99-172545 | 6/1999 |
| JP | 2001-303394 | 10/2001 |
| JP | 2001-316923 | 11/2001 |
| JP | 2002-004145 | 1/2002 |
| JP | 2002-155449 | 5/2002 |
| JP | 2002-180354 | 6/2002 |
| JP | 2003-147661 | 5/2003 |
| WO | WO0164978 A | 9/2001 |

OTHER PUBLICATIONS

International Search Report of PCT/US2004/036378.

* cited by examiner

*Primary Examiner*—Gary L. Welch
*Assistant Examiner*—Robert H Muromoto
(74) *Attorney, Agent, or Firm*—Christina W. Geerlof; Anne I. Breikss

(57) ABSTRACT

Warp stretch woven fabrics including plain, twill and satin constructions are disclosed. The fabrics include weft yarns and warp yarns. About 15 weight percent to about 55 weight percent of the warp yarns are polyester bicomponent continuous filaments comprising poly(ethylene terephthalate) and poly(trimethylene terephthalate) having an after-heat-set crimp contraction value from about 20% to about 80%.

7 Claims, No Drawings

WARP-STRETCH WOVEN FABRICS COMPRISING POLYESTER BICOMPONENT FILAMENTS

FIELD OF THE INVENTION

This invention relates to woven fabrics, particularly woven fabrics comprising polyester bicomponent filaments of poly(ethylene terephthalate) and poly(trimethylene terephthalate) oriented in the warp direction of the woven fabric.

DESCRIPTION OF BACKGROUND ART

Generally, polyester bicomponent fibers comprising poly (ethylene terephthalate) and poly(trimethylene terephthalate) are known. Such fibers are disclosed for example in U.S. Published patent application No. US2001/0055683. Such fibers have been used in woven fabrics, as disclosed in U.S. Published patent application No. 2003/0092339 and in Japanese Published Patent Application Nos. JP2002-004145, JP2001-303394, JP11-172545, JP2001-316923, JP2002-180354, and JP2002-1555449. However, such fabrics can have unnecessarily high proportions of polyester bicomponent fibers, and fabrics that use such fibers more efficiently are sought.

SUMMARY OF THE INVENTION

The present invention relates to a warp-stretch woven fabric of a plain, twill, or satin construction. The woven fabric has weft yarns and warp yarns, and from about 15 to about 55 weight percent of the warp yarns are polyester bicomponent continuous filaments comprising poly(ethylene terephthalate) and poly(trimethylene terephthalate). The polyester bicomponent warp yarns have an after-heat-set crimp contraction value preferably of about 20% to about 80%.

DETAILED DESCRIPTION OF THE PREFERRED EMBODIMENT

It has now been found that warp-stretch woven fabrics can be prepared with unexpectedly high stretch and recovery properties despite comprising comparatively low levels of certain polyester bicomponent yarns.

As used herein, "polyester bicomponent filament" means a continuous filament comprising a pair of polyesters intimately adhered to each other along the length of the filament, so that the filament cross-section is for example a side-by-side, eccentric sheath-core or other suitable cross-section from which useful crimp can be developed. "Yarn" means a plurality of continuous filaments. "Pick-and-pick" means a woven construction in which a polyester bicomponent filament weft yarn ("first yarn") and a ("second") weft yarn are in alternating picks of the fabric. "Co-insertion" means a woven construction in which a polyester bicomponent filament yarn ("first yarn") and a ("second") weft yarn have been woven as one, in the same pick. "Woven separately" means the yarns are separate from each other within the finished fabric, without having been twisted or entangled together before being woven; herein "woven separately" does not preclude weaving collections of substantially similar filaments (optionally interlaced with each other) or weaving into a co-insertion construction.

The fabric of the invention is a warp-stretch woven selected from the group consisting of plain, twill, and satin constructions. The warp-stretch woven has weft yarns and warp yarns, wherein from about 15 to about 55 weight percent (preferably about 22 to about 33 weight percent) of the warp yarns are polyester bicomponent continuous filaments comprising poly(ethylene terephthalate) and poly (trimethylene terephthalate). The other warp yarns can be, for example, spun staple yarns, such as cotton, wool, or linen; they can also be of monocomponent poly(ethylene terephthalate) fibers, monocomponent poly(trimethylene terephthalate) fibers, polycaprolactam fibers, poly(hexamethylene adipamide) fibers, acrylic fibers, modacrylic fibers, acetate fibers, rayon fibers, and combinations thereof.

The weft yarns can be the same as, or different from, the warp yarns. The fabric can be warp-stretch only, or it can be bi-stretch, in which useful stretch and recovery properties are exhibited in both the warp and weft directions; such weft-stretch can be provided by polyester bicomponent filament yarns, spandex, melt-spun elastomer, and the like. When the weft yarns comprise polyester bicomponent filament ("first") yarns, they can be present with a second yarn (optionally a spun staple yarn), for example, in a pick-and-pick or co-insertion construction.

The bicomponent filament yarns can be present from about 13 to about 28 weight percent (preferably about 13 to about 19 weight percent), based on total fabric weight when none of the polyester bicomponent filaments are present in the weft (i.e., when the polyester bicomponent filaments are only present in the warp).

The polyester bicomponent filaments comprise poly(ethylene terephthalate) and poly(trimethylene terephthalate) in a weight ratio of about 30/70 to about 70/30, and have an after-heat-set crimp contraction value from about 20% to about 80%, preferably about 30% to about 60%. Various comonomers can be incorporated into the polyesters of the bicomponent filament in minor amounts, provided such comonomers do not have an adverse effect on the amount of fiber crimp, and if the benefits of the invention are not deleteriously affected. Examples include linear, cyclic, and branched aliphatic dicarboxylic acids (and their diesters) having 4–12 carbon atoms; aromatic dicarboxylic acids (and their esters) having 8–12 carbon atoms (for example isophthalic acid, 2,6-naphthalenedicarboxylic acid, and 5-sodium-sulfoisophthalic acid); and linear, cyclic, and branched aliphatic diols having 3–8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol). Isophthalic acid, pentanedioic acid, 5-sodium-sulfoisophthalic acid, hexanedioic acid, 1,3-propane diol, and 1,4-butanediol are preferred. The polyesters can also have incorporated therein additives, such as titanium dioxide.

The linear density of the polyester bicomponent filament yarn of which the fabric of the invention is comprised can range from about 70 denier to about 900 denier (78 dtex to 1000 dtex).

It is preferred that the polyester bicomponent filament yarns not be twisted or entangled combinations of bicomponent filaments with other, for example, monocomponent or staple, fibers. In other words, it is preferred that the bicomponent filament yarns be woven separately from the other yarns in the fabric in order to avoid the expense of an additional step, to obtain high stretch and recovery properties, and to give high fabric surface smoothness.

It is further preferred that less than about 3 wt % of a resin or similar material be in or affixed to the fabric, because such resin treatment can add expense, and the benefits of the invention are achieved without incurring this expense.

Another benefit of the invention is that the polyesters in the bicomponent filaments need not be partially removed from the fabric by chemical means, for example, by application of a chemical treatment such as a highly alkaline solution. While such resin and chemical treatments might still be used in conjunction with the invention, we believe that stretch and recovery properties of the woven fabric may be compromised, and thus prefer to eliminate such added steps.

The fabric of the invention can be of plain, twill, or satin construction. Examples of useful twill constructions include regular twills (for example, 2/1, 1/2, 1/3, and 2/2 twills), modified twills (in which additional lifts have been added to the weaving plan), herringbone, and pointed twills. Examples of useful satin constructions include 5-end (for example 1/5 and 2/5) and 8-end (for example 3/8) weaves.

Loom types that can be used to make the woven fabrics of the invention include air-jet looms, shuttle looms, water-jet looms, rapier looms, and gripper (projectile) looms.

Before being tested, fabrics and fibers were conditioned for 16 hours at 21° C.+/−1° C. and 65% +/−2% relative humidity.

After-heat-set contraction values were measured as follows. A sample of the bicomponent polyester filament to be used was formed into a skein of 5000+/−5 total denier (5550 dtex) with a skein reel at a tension of about 0.1 gpd (0.09 dN/tex). The skein was conditioned at 70+/−2° F. (21+/−1° C.) and 65+/−2% relative humidity for a minimum of 16 hours. The skein was hung substantially vertically from a stand, a 1.5 mg/den (1.35 mg/dtex) weight (e.g. 7.5 g for a 5550 dtex skein) was hung on the bottom of the skein, the weighted skein was allowed to come to an equilibrium length, and the length of the skein was measured to within 1 mm and recorded as "$C_b$". The 1.35 mg/dtex weight was left on the skein for the duration of the test. Next, a 500 g weight (100 mg/d; 90 mg/dtex) was hung from the bottom of the skein, and the length of the skein was measured to within 1 mm and recorded as "$L_b$". Crimp contraction value (percent) (before heat-setting, as described below for this test), "$CC_b$", was calculated according to the formula $$CC_b=100\times(L_b-C_b)/L_b.$$

The 500 g weight was removed and the skein was then hung on a rack and heat-set, with the 1.35 mg/dtex weight still in place, in an oven for 5 minutes at about 225° F. (107° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "$C_a$". The 500 g weight was again hung from the skein, and the skein length was measured as above and recorded as "$L_a$". The after heat-set crimp contraction value (%), "$CC_a$", was calculated according to the formula $$CC_a=100\times(L_a-C_a)/L_a.$$

In the Examples, unless otherwise noted, a Dornier rapier loom was used at 500 picks per minute to make plain wovens with 55 picks per inch (22 picks/cm) and 1/3 twills with 62 picks per inch (24 picks/cm) in the loomstate. The yarn of poly(ethylene terephthalate) and poly(trimethylene terephthalate) ("bicomponent polyester yarn") was 150 denier (167 dtex), 34 filament T-400 Elasterelle, available from DuPont Textiles and Interiors; it was 40 wt % poly (ethylene terephthalate) and 60 wt % poly(trimethylene terephthalate) and had an after-heat-set crimp contraction value of 47%. Before beaming, bicomponent fiber yarns to be used in the warp were sized at 300 yards/minute (274 m/min) with a poly(vinyl alcohol) size using a Suziki single end sizing machine in which the temperature in the sizing bath was set at 107° F. (42° C.). The sized yarn was dried at 190° F. (88° C.) for about 5 minutes. The fill yarn was ring-spun cotton of 30 cotton count. Poly(ethylene terephthalate) yarn ("monocomponent polyester yarn"), when used, was a textured and interlaced 150 denier (167 dtex), 50 filament yarn produced by Unifi, Inc.

Each greige fabric was finished by passing it under low tension through hot water three times at 160° F., 180° F. and 202° F. (71° C., 82° C., and 94° C., respectively); then de-sizing/pre-scouring it with 6 wt % Synthazyme® (a starch-hydrolyzing enzyme from Dooley Chemicals LLC), 1 wt % Lubit® 64 (a nonionic lubricant from Sybron, Inc.), and 0.5 wt % Merpol® LFH (a surfactant and registered trademark of E. I. du Pont de Nemours and Company) at 160° F. (71° C.) for 30 minutes, followed by addition of 0.5 wt % trisodium phosphate. The fabric was then scoured with 1 wt % Lubit® 64 and 1 wt % Merpol® LFH at 110° F. (43° C.) for 5 minutes, jet-dyed with a yellow disperse dye (and a yellow reactive dye when cotton was present in the fabric) at 230° F. (110° C.) for 30 min at pH 5.2, and then heat-set on a tenter frame at 340° F. (171° C.) for 40 sec while being underfed in the warp direction. (Weight percents for finishing components are based on fabric weight.)

The Percent Available Stretch of the fabrics in the Examples was measured as follows. Three 60×6.5 cm sample specimens were cut from each fabric. The long dimension corresponded to the warp direction. Each specimen was unraveled equally on each side until it was 5 cm wide. One end of the fabric was folded to form a loop, and a seam was sewn across the width to fix the loop. At 6.5 cm from the unlooped end of the fabric a first line was drawn, and 50 cm away ("GL") from the first line, a second line was drawn. The sample was conditioned for at least 16 hours at 20+/−2° C. and 65+/−2% relative humidity. The sample was then clamped at the first line and hung vertically. A 30 newton weight was hung from the loop, and the sample was exercised 3 times by alternately allowing it to be stretched by the weight for 3 seconds and then supporting the weight so the fabric was unloaded. The weight was re-applied, and the distance between the lines ("ML") was recorded to the nearest millimeter. Percent Available Stretch was calculated from Formula I, $$\%\ \text{Available Stretch}=100\times(ML-GL)/GL \quad \text{(I)}$$

and the results from the three specimens were averaged.

The Percent Recovery of the fabrics in the Examples was calculated as 100% minus Percent Fabric Growth (% Fabric Growth), which was measured as follows. Three new specimens were prepared as described for the Available Stretch test, extended to 80% of the previously determined Available Stretch, and held in the extended condition for 30 minutes. They were then allowed to relax without restraint for 60 minutes, and the length ("$L_2$") between the lines was again measured. Percent Fabric Growth was calculated from Formula II, $$\%\ \text{Fabric Growth}=100\times(L_2-GL)/GL \quad \text{(II)}$$

and the results from the three specimens were averaged.

In describing warp yarn repeating patterns in the fabric constructions of the Examples, "bi" means bicomponent and "mono" means monocomponent. The repeating patterns used were those that were most uniform for the weight percent of bicomponent filament warp yarns present. For example, when the bicomponent filament yarns were at a 50 weight percent level, the repeating pattern was bi/mono/bi/mono rather than bi/bi/mono/mono, and when the bicomponent filament yarns were present at a 33 weight percent level in the warp, the repeating pattern was bi/mono/mono/bi/mono/mono rather than bi/bi/mono/mono/mono/mono. Although using most uniform repeating patterns for obtaining high fabric uniformity in surface appearance, stretch, and recovery, such patterns are not required.

Available Stretch ("Stretch") and "Recovery" properties of the fabrics made in the Examples are presented in Tables I (plain wovens) and II (twills). For clarity, the yarns used in the Examples had the same linear density, so that warp end percent is equal to warp weight percent. In the Tables, "Bicomponent weight percent" is based on total warp weight. "Stretch per bicomponent wt %" and "Recovery per bicomponent wt %" refers to the relative amount of bicomponent polyester yarn in the warp only.

EXAMPLES

Example 1

A plain woven fabric was made in which the warp had a 1:1 end ratio (50/50 weight ratio) of bicomponent polyester yarn to monocomponent polyester yarn, arranged alternately at 86 ends/inch (34 ends/cm) in the loom state. The fabric was 80 inches (203 cm) wide on the loom and 78 inches (198 cm) wide off the loom in the greige state. After dyeing and finishing, the fabric had yarn densities of 100 ends/inch (39 ends/cm) and 96 picks/inch (38 picks/cm), weighed 4.86 oz/yd$^2$ (165 g/m$^2$), and contained 28 wt % bicomponent polyester yarn, based on total fabric weight.

Example 2

A plain woven fabric was made in which the warp had a 1:2 end ratio (33/67 weight ratio) of bicomponent polyester yarn to monocomponent polyester yarn, arranged in a bi/mono/mono repeating pattern at 86 ends/inch (34 ends/cm) in the loom state. The fabric was 80 inches (203 cm) wide on the loom and 78 inches (198 cm) wide off the loom in the greige state. After dyeing and finishing, the fabric had yarn densities of 90 ends/in (35 ends/cm) and 97 picks/in (38 ends/in), weighed 4.49 oz/yd$^2$ (152 g/m$^2$), and contained 19 wt % bicomponent polyester yarn, based on total fabric weight.

Example 3

A plain woven fabric was made in which the warp had a 1:3 end ratio (25/75 weight ratio) of bicomponent polyester yarn to monocomponent polyester yarn, arranged in a bi/mono/mono/mono repeating pattern at 86 ends/inch (34 ends/cm) in the loom state. The fabric was 80 inches (203 cm) wide on the loom and 78 inches (198 cm) wide off the loom in the greige state. After dyeing and finishing, the fabric had yarn densities of 100 ends/in (39 ends/cm) and 95 picks/inch (37 picks/cm), weighed 4.55 oz/yd$^2$ (154 g/m$^2$), and contained 14 wt % bicomponent polyester yarn, based on total fabric weight.

Example 4

A twill fabric was made in which the warp had a 1:1 end ratio (50/50 weight ratio) of bicomponent polyester yarn to monocomponent polyester yarn, arranged alternately at 86 ends/inch (34 ends/cm) in the loom state. The fabric was 80 inches (203 cm) wide on the loom and 75 inches (190 cm) wide in the greige state. After dyeing and finishing, the fabric had yarn densities of 104 ends/inch (41 ends/cm) and 88 picks/inch (35 picks/cm), weighed 5.47 oz/yd$^2$ (185 g/m$^2$), and contained 27 wt % bicomponent polyester yarn, based on total fabric weight.

Example 5

A twill fabric was woven in which the warp had a 1:2 end ratio (33/67 weight ratio) of bicomponent polyester yarn to monocomponent polyester yarn, arranged in a bi/mono/mono repeating pattern at 86 ends/inch (34 ends/cm) in the loom state. The fabric was 80 inches (203 cm) wide on the loom and 75 inches (190 cm) wide in the greige state. After dyeing and finishing, the fabric had yarn densities of 90 ends/inch (35 ends/cm) and 92 picks/inch (36 picks/cm), weighed 4.92 oz/yd$^2$ (167 g/m$^2$), and contained 18 wt % bicomponent polyester yarn, based on total fabric weight.

Example 6

A twill fabric was made in which the warp had a 1:3 end ratio (25/75 weight ratio) of bicomponent polyester yarn to monocomponent polyester yarn, arranged in a bi/mono/mono/mono repeating pattern at 86 ends/inch (34 ends/cm) in the loom state. The fabric was 80 inches (203 cm) wide on the loom and 78 inches (198 cm) wide in the greige state. After dyeing and finishing, the fabric had yarn densities of 100 ends/inch (39 ends/cm) and 107 picks/inch (42 picks/cm), weighed 5.67 oz/yd$^2$ (192 g/m$^2$), and contained 13 wt % bicomponent polyester yarn, based on total fabric weight.

Example 7

A plain woven fabric was made in which the warp had a 1:1 end ratio (50/50 weight ratio) of bicomponent polyester yarn to sized 30 cotton count ring-spun cotton, arranged alternately at 86 ends/inch (34 ends/cm) in the loom state. The fabric was 80 inches (203 cm) wide on the loom and 78 inches (198 cm) wide in the greige state. After dyeing and finishing, the gray fabric had yarn densities of 88 ends/inch (35 ends/cm) and 98 picks/inch (39 picks/cm), weighed 4.78 oz/yd$^2$ (162 g/m$^2$), and contained 28 wt % bicomponent polyester yarn, based on total fabric weight.

Example 8

A twill fabric was made in which the warp had a 1:2 end ratio (33/67 weight ratio) of bicomponent polyester yarn to monocomponent polyester yarn, arranged in a bi/mono/mono repeating pattern at 86 ends/inch (34 ends/cm) in the loom state. The weft yarn was monocomponent polyester yarn. The fabric was 80 inches (203 cm) wide on the loom and 75 inches (190 cm) wide in the greige state. After dyeing and finishing, the fabric had yarn densities of 120 ends/inch (47 ends/cm) and 90 picks/inch (35 picks/cm), weighed 5.85 oz/yd$^2$ (198 g/m$^2$), and contained 18 wt % bicomponent polyester yarn, based on total fabric weight.

Example 9

A plain woven fabric was made in which the warp had a 1:1 end ratio (50/50 weight ratio) of bicomponent polyester yarn to monocomponent polyester yarn, arranged alternately at 86 ends/inch (34 ends/cm) in the loom state. The weft yarn was entirely of bicomponent polyester yarn. The fabric was 80 inches (203 cm) wide on the loom and 76 inches (193 cm) wide in the greige state. After dyeing and finishing, the fabric had available stretch in the warp and weft directions of 26% and 25%, respectively, and yarn densities of 112 ends/inch (44 ends/cm) and 95 picks/inch (37 picks/cm). The weight of the fabric was 5.8 oz/yd$^2$ (197 g/m$^2$), and it contained 72 wt % bicomponent polyester yarn, based on total fabric weight.

Example 10

A twill fabric was woven in which the warp had a 1:1 end ratio (50/50 weight ratio) of bicomponent polyester yarn to monocomponent polyester yarn, arranged alternately at 86 ends/inch (34 ends/cm) in the loom state. The weft yarns were bicomponent polyester yarn and 30 cotton count ring-spun cotton, woven pick-and-pick. The fabric was 80 inches (203 cm) wide on the loom and 76 inches (193 cm) wide in the greige state. After dyeing and finishing, the fabric had available stretch of 50% and 17% in the warp and weft directions, respectively, and yarn densities of 115 ends/inch (45 ends/cm) and 90 picks/inch (35 picks/cm). The fabric weighed 6.44 oz/yd$^2$ (218 g/m$^2$), and it contained 50 wt % bicomponent polyester yarn, based on total fabric weight.

Example 11

A plain woven fabric was made in which the warp had a 1:1 end ratio (50/50 weight ratio) of bicomponent polyester yarn to monocomponent polyester yarn, arranged alternately at 86 ends/inch (34 ends/cm) in the loom state. The weft yarns were bicomponent polyester yarn and monocomponent polyester yarn, woven pick-and-pick. The fabric was 80 inches (203 cm) wide on the loom and 75 inches (190 cm) wide in the greige state. After dyeing and finishing, the fabric had 31% and 18% available stretch in the warp and weft directions, respectively, and yarn densities of 94 ends/inch (37 ends/cm) and 102 picks/inch (40 picks/cm). The fabric weighed 5.64 oz/yd$^2$ (191 g/m$^2$), and it contained 50 wt % bicomponent polyester yarn, based on total fabric weight.

Example 12 (Comparison)

A plain woven fabric was made in which the warp was entirely bicomponent polyester yarn; that is, the end ratio was 1:0. The weft yarn was 30 cc ring-spun cotton. A Ruti air-jet loom was used at 500 picks per minute. On the loom, the yarn counts were 70 ends/inch (28 ends/cm) and 50 picks/inch (20 picks/cm). The fabric was 67 inches (170 cm) wide on the loom and 65 inches (165 cm) in the greige state. After dyeing and finishing, the fabric had a weight of 3.47 oz/yd$^2$ (118 g/m$^2$) and yarn densities of 74 ends/inch (29 ends/cm) and 72 picks/inch (28 picks/cm), and it contained 54 wt % bicomponent polyester yarn, based on total fabric weight.

TABLE I

| Example | End ratio | Warp Bicomponent Weight % | Fabric Stretch, % | Stretch per warp bicomponent wt % | Fabric Recovery, % | Recovery per warp bicomponent wt % |
|---|---|---|---|---|---|---|
| 1 | 1:1 | 50 | 34 | 0.7 | 98 | 2.0 |
| 2 | 1:2 | 33 | 23 | 0.7 | 98 | 3.0 |
| 3 | 1:3 | 25 | 25 | 1.0 | 99 | 4.0 |
| 7 | 1:1 | 50 | 36 | 0.7 | Nm | nm |
| 9 | 1:1 | 50 | 26 | 0.5 | Nm | nm |
| 11 | 1:1 | 50 | 31 | 0.6 | Nm | nm |
| 12 (Comp.) | 1:0 | 100 | 30 | 0.3 | 99 | 1.0 |

TABLE II

| Example | End ratio | Warp Bicomponent Weight % | Fabric Stretch, % | Stretch per warp bicomponent wt % | Fabric Recovery, % | Recovery per warp bicomponent wt % |
|---|---|---|---|---|---|---|
| 4 | 1:1 | 50 | 43 | 0.9 | 97 | 1.9 |
| 10 | 1:1 | 50 | 50 | 1.0 | Nm | nm |
| 5 | 1:2 | 33 | 28 | 0.8 | 99 | 3.0 |
| 8 | 1:2 | 33 | 23 | 0.7 | Nm | nm |
| 6 | 1:3 | 25 | 27 | 1.1 | 98 | 3.9 |

The data in Tables I and II show that unexpectedly and disproportionately (compared to their bicomponent filament yarn content) high stretch and recovery properties are exhibited by the fabrics of the invention. The designation "nm" indicates a value was "not measured".

What is claimed is:

1. A warp-stretch woven fabric selected from the group consisting of plain, twill and satin construction, comprising:

a plurality of weft yarns and a plurality of warp yarns, wherein from about 15 to about 55 weight percent of the warp yarns are polyester bicomponent continuous filaments comprising poly(ethylene terephthalate) and poly(trimethylene terephthalate) and having an after-heat-set crimp contraction value from about 20% to about 80%.

2. The fabric according to claim 1 wherein from about 22 to about 33 weight percent of the warp yarns are polyester bicomponent continuousfilaments.

3. The fabric according to claim 1, wherein the bicomponent continuous filament warp yarns are woven separately from other warp yarns in the woven fabric construction.

4. The fabric of claim 1, comprising from about 13 weight percent to about 28 weight percent polyester bicomponent yarns, based on total fabric weight, wherein the bicomponent yarns are present only in the warp.

5. The fabric of claim 1, comprising from about 13 weight percent to about 19 weight percent polyester bicomponent yarns, based on total fabric weight.

6. The fabric of claim 1, wherein a portion of the warp yarns axe selected from the group consisting of: spun staple yarns, monocomponent poly(ethylene terephthalate) fibers, monocomponent poly(trimethylene terephthalate) fibers, polycaprolactam fibers, poly(hexamethylene adipamide) fibers, acrylic fibers, modacrylic fibers, acetate fibers, rayon fibers, and combinations thereof.

7. The fabric of claim 1, wherein said fabric comprises a twill construction.

* * * * *